US009624086B2

(12) United States Patent
Banning et al.

(10) Patent No.: US 9,624,086 B2
(45) Date of Patent: Apr. 18, 2017

(54) ACCESSIBLE FAUCET HANDLE

(71) Applicant: BUNN-O-MATIC CORPORATION, Springfield, IL (US)

(72) Inventors: Jason Banning, Springfield, IL (US); Crescent Burke, Springfield, IL (US); Jane Harris, Springfield, IL (US)

(73) Assignee: Bunn-O-Matic Corporation, Springfield, IL (US)

( * ) Notice: Subject to any disclaimer, the term of this patent is extended or adjusted under 35 U.S.C. 154(b) by 0 days.

(21) Appl. No.: 13/921,064

(22) Filed: Jun. 18, 2013

(65) Prior Publication Data

US 2013/0334262 A1 Dec. 19, 2013

Related U.S. Application Data

(60) Provisional application No. 61/661,127, filed on Jun. 18, 2012.

(51) Int. Cl.
*B67D 3/00* (2006.01)
*B67D 3/04* (2006.01)

(52) U.S. Cl.
CPC ..... *B67D 3/0058* (2013.01); *B67D 3/04* (2013.01)

(58) Field of Classification Search
CPC ..... B67D 3/04; B67D 3/0058; B67D 3/043; B67D 3/045; B67D 2210/00094; F16K 27/065; F16K 99/0007; F16K 1/20; F16K 1/2007; F16K 41/10; F16K 31/52; F16K 31/522; F16K 31/524; F16K 31/52458
USPC ..... 222/505, 509, 511, 517, 518, 559; 251/231, 236, 242, 244, 245, 246, 263, 251/331
See application file for complete search history.

(56) References Cited

U.S. PATENT DOCUMENTS

| | | | | | |
|---|---|---|---|---|---|
| 14,429 | A | * | 3/1856 | Woodbury | 251/233 |
| 2,023,560 | A | * | 12/1935 | Wayer | 251/189 |
| 2,039,933 | A | * | 5/1936 | Rupert | F16K 21/00 251/233 |
| 2,305,438 | A | * | 12/1942 | Michaels | 137/385 |
| 2,649,111 | A | * | 8/1953 | Anderson | 137/304 |
| 3,104,089 | A | * | 9/1963 | Seltsam | B67D 1/1466 16/441 |
| 3,246,872 | A | * | 4/1966 | Seltsam | 251/331 |
| 3,301,525 | A | * | 1/1967 | Chernak | B67D 1/1466 251/331 |
| 3,426,798 | A | * | 2/1969 | Chernak | 137/625.33 |

(Continued)

*Primary Examiner* — Patrick M Buechner
(74) *Attorney, Agent, or Firm* — Barnes & Thornburg LLP

(57) ABSTRACT

A faucet assembly for dispensing liquids from a container. The faucet assembly includes a handle assembly that is connectable to a liquid dispenser of a container for use with a variety of liquids. The faucet assembly is configured to be compatible with the Americans with Disabilities Act ("ADA") Guidelines requiring certain features of equipment to be located to allow access to a person who might have a temporary or permanent disability and require a faucet assembly connected to a liquid or beverage container to be lower than a certain height and depth or set back dimension when the container is placed on a surface for dispensing the liquid from the container. A faucet assembly with a handle assembly that extends downwardly and outwardly from the top of the faucet assembly to ensure the faucet can be actuated by a person within the ADA Guidelines.

10 Claims, 6 Drawing Sheets

(56) References Cited

U.S. PATENT DOCUMENTS

| | | | | | |
|---|---|---|---|---|---|
| 3,459,345 | A | * | 8/1969 | Giese et al. | 222/505 |
| 3,539,151 | A | * | 11/1970 | Reid et al. | 251/242 |
| 5,470,044 | A | * | 11/1995 | Chi | F16K 35/025 222/153.1 |
| 5,788,840 | A | * | 8/1998 | Lee et al. | 210/435 |
| 5,811,001 | A | * | 9/1998 | Chang | 210/238 |
| 6,086,045 | A | * | 7/2000 | Moon | F16K 35/025 251/109 |
| 6,454,243 | B2 | * | 9/2002 | Kawolics et al. | 251/262 |
| D582,209 | S | * | 12/2008 | Thomas | D7/398 |
| D587,964 | S | * | 3/2009 | Thomas | D7/398 |
| D632,368 | S | * | 2/2011 | Kolar et al. | D23/250 |
| 2001/0032954 | A1 | * | 10/2001 | Kawolics | F16K 31/52 251/262 |
| 2008/0169440 | A1 | * | 7/2008 | Meyer | B67D 3/0058 251/95 |

* cited by examiner

ACCESSIBLE FAUCET HANDLE

CROSS REFERENCE TO RELATED APPLICATIONS

This application claims the benefit of priority under 35 C. §119(e) to U.S. Provisional Patent Application No. 61/661,127, filed Jun. 18, 2012. The disclosure set forth in the referenced application is incorporated herein by reference in its entirety.

BACKGROUND

The present disclosure relates to a faucet assembly for dispensing liquids from a container, and more particularly, to a handle assembly that is connectable to a liquid dispenser of a container for use with a variety of liquids, including but not limited to beverages, in order to selectively dispense or stop dispensing the flow of the liquid.

The faucet assembly of the present disclosure is configured to be compatible with Guidelines of the Americans with Disabilities Act ("ADA"). The ADA provides Guidelines which require certain features of various equipment (, controls, access, etc) to be set at a dimension or a range of dimensions that would allow access to a person who might have a temporary or permanent disability, by way of example, but not limitation, a person seated in a wheelchair. In particular, these guidelines require a faucet assembly connected to a liquid or beverage container to be lower than a certain height and depth or set back dimension when the container is placed on a countertop or table for dispensing the liquid from the container. This requirement ensures the faucet actuator or handle can be reached by a person in a wheelchair or other device.

The present disclosure relates to a faucet assembly with a handle assembly that extends downwardly and outwardly from the top of the faucet assembly to ensure the faucet can be actuated by a person, within the ADA Guidelines, such as a person in a wheelchair when the container is placed on a raised surface such as a countertop. Traditional faucet assemblies have a nozzle with a handle extending directly upwardly from the top of the nozzle, resulting in a situation where a wheelchair-bound user may not be able to reach the top grip of the handle to actuate or comfortably operate the faucet assembly. Inevitably, these faucets place the control feature of the faucet outside of the dimensional range or dimensional envelope of the established ADA Guidelines.

SUMMARY

A faucet assembly in accordance with the present disclosure includes a liquid dispenser, a valve assembly, and a handle associated with the valve assembly. The liquid dispenser includes a nozzle and a dispenser body that is connectable to a variety of different liquid containers that can store hot or cold liquid. The valve assembly is coupled to the liquid dispenser and configured to move between a closed position to block the discharge of liquid from the container and an open position to allow the discharge of liquid or to dispense liquid from the container.

In illustrative embodiments, the handle assembly includes a lever that extends downward and away from the top of the liquid dispenser and a base that is connectable to the valve assembly. By configuring the lever to extend downward and away from the liquid dispenser, the faucet assembly of the present disclosure is accessible and operatable by a wheelchair-bound user and compliant with ADA Guidelines.

In illustrative embodiments, the handle assembly includes a gripping portion that is angled outward from the liquid dispenser to allow more space for a user's finger to access a contoured grip on the gripping portion. In this way, handle assembly provides an understandable means for operating the handle assembly in an upward fashion in a direction away from the bottom of liquid dispenser to actuate the liquid dispenser.

In illustrative embodiments, the handle assembly includes pivot pins that may be used to removably or permanently couple the handle assembly to any traditional or standard valve assembly for use with any traditional or standard liquid dispenser. In the case of removable pivot pins, the handle assembly of the present disclosure may be interchangeable with handles currently used by standard faucet assemblies in order to modify them to meet the ADA Guidelines.

In illustrative embodiments, the faucet assembly is configured to prevent unintentional operation or actuation of the nozzle but still facilitate intentional, controlled operation. The handle assembly of the present disclosure includes an abutment nub on the back of the handle assembly to block unintentional movement of the lever in a backward direction toward the liquid dispenser. This also provides resistance to a user as tactile guidance that the handle assembly is not configured to operate in a backward direction.

In illustrative embodiments, the faucet assembly is also configured to be arranged in a service position, whereby the faucet assembly may be positioned to allow the nozzle to be maintained in the open position without continued upward forced applied by the user. This service position allows the faucet assembly to be retained in such a way that free flow draining of liquid from the container to which the faucet is attached may be accomplished during a service operation such as cleaning.

This background information is provided to provide some information believed by the applicant to be of possible relevance to the present disclosure. No admission is intended, nor should such admission be inferred or construed, that any of the preceding information constitutes prior art against the present disclosure. Other aims, objects, advantages and features of the disclosure will become more apparent to those skilled in the art upon reading of the following non-restrictive description of specific embodiments thereof, given by way of illustration and not limitation with reference to the accompanying drawings.

BRIEF DESCRIPTION OF THE DRAWINGS

The present disclosure will be described hereafter with reference to the attached drawings which are given as a non-limiting example only, in which.

Figure 1:
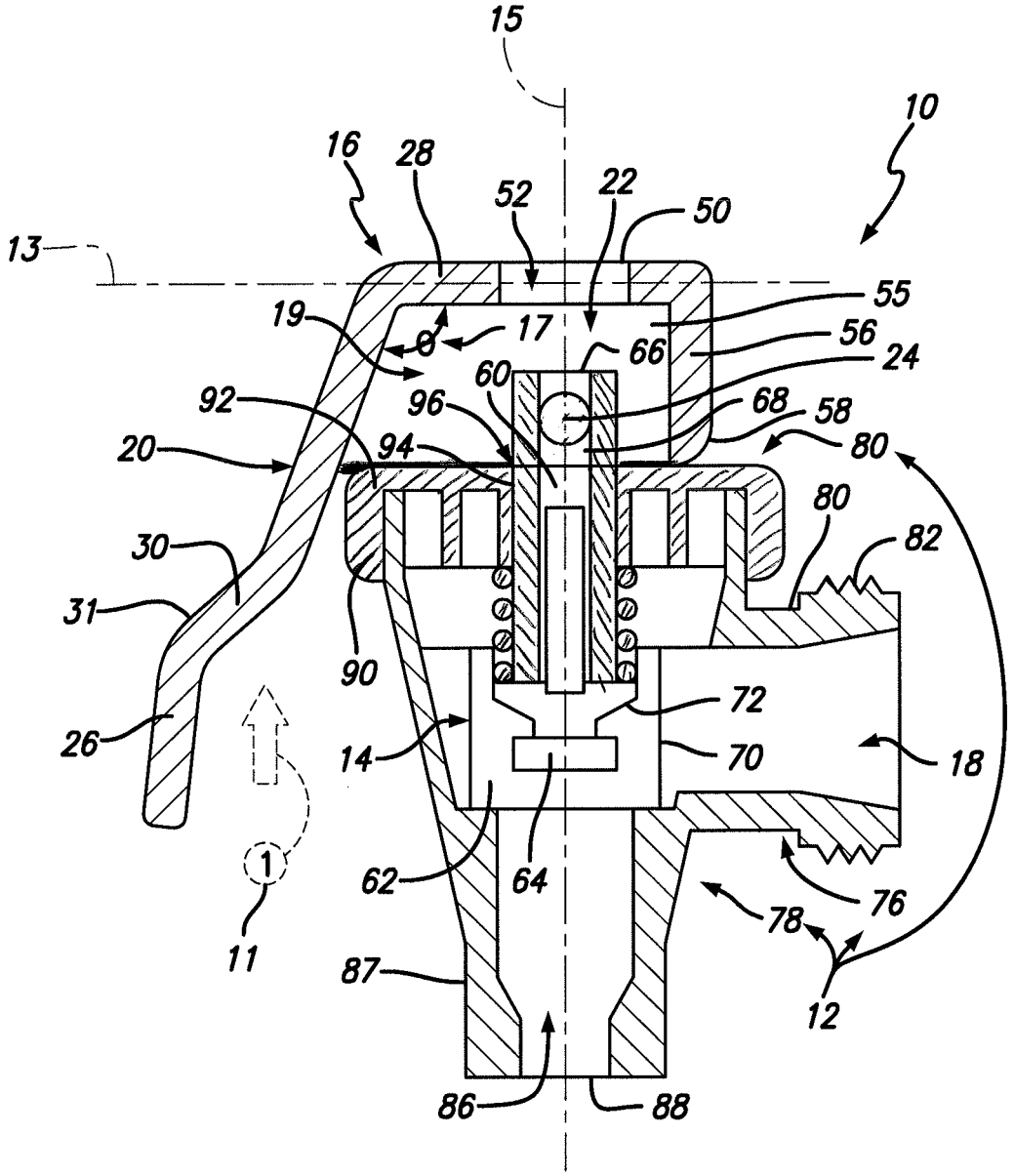
FIG. 1 is an enlarged sectional view of a faucet assembly showing that the faucet assembly includes a liquid dispenser, a valve assembly coupled to the liquid dispenser, and a handle assembly in accordance with the present disclosure coupled to the valve assembly, wherein the handle assembly is in a first position in which the valve assembly is in a closed position relative to the liquid dispenser for blocking movement of liquid from the liquid dispenser and showing the handle assembly includes a downward extending lever to provide accessible control and operation of the valve assembly.

The exemplification set out herein illustrates embodiments of the disclosure that are not to be construed as limiting the scope of the disclosure in any manner. Additional features of the present disclosure will become apparent to those skilled in the art upon consideration of the following detailed description of illustrative embodiments exemplifying the best mode of carrying out the disclosure as presently perceived.

DETAILED DESCRIPTION

While the present disclosure may be susceptible to embodiment in different forms, there is shown in the drawings, and herein will be described in detail, embodiments with the understanding that the present description is to be considered an exemplification of the principles of the disclosure. The disclosure is not limited in its application to the details of structure, function, construction, or the arrangement of components set forth in the following description or illustrated in the drawings. The disclosure is capable of other embodiments and of being practiced or of being carried out in various ways. Also, it is to be understood that the phraseology and terminology used herein is for the purpose of description and should not be regarded as limiting. The use of various phrases and terms is meant to encompass the items or functions identified and equivalents thereof as well as additional items or functions. Unless limited otherwise, various phrases, terms, and variations thereof herein are used broadly and encompass all variations of such phrases and terms. Furthermore, and as described in subsequent paragraphs, the specific configurations illustrated in the drawings are intended to exemplify embodiments of the disclosure. However, other alternative structures, functions, and configurations are possible which are considered to be within the teachings of the present disclosure. Furthermore, unless otherwise indicated, the term "or" is to be considered inclusive.

Beverages and related ingredients may be described in the present application and will be generally referred to as "coffee". However, it should be understood that the term beverage ingredient should be broadly interpreted regardless of reference to beverage ingredient or coffee. Also, the characteristics or form of the beverage ingredient can be any variety of ingredients which are currently known or hereafter developed. The form of the beverage ingredient may include powder, liquid, gel, crystal, flake, freeze-dried and any other form or state regardless of temperature, phase or other characteristics. Reference to beverage dispensing includes reconstituting, brewing, steeping or any other form of combining a dilution ingredient with a beverage ingredient.

Moreover, while "beverage" is referred to, it is envisioned that any variety of food ingredients could be placed in an ingredient container for dispensing. In this regard, the food could take the form of water, juice, coffee, tea, other flavored beverages, as well as other foods.

Figure 2:
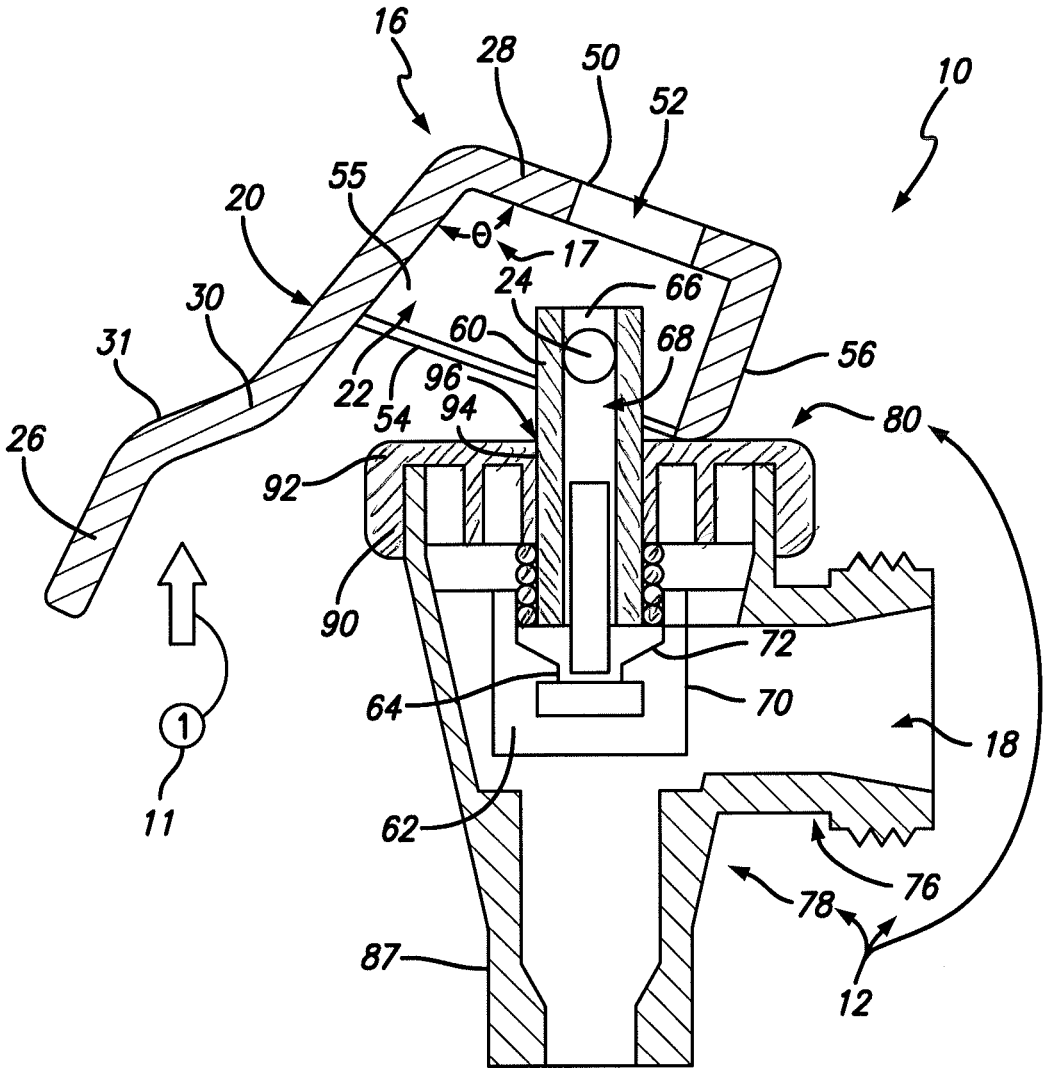
FIG. 2 is a view similar to FIG. 1 showing the handle assembly in a second position in which the valve assembly is in a open position relative to the liquid dispenser for allowing movement of liquid from the liquid dispenser out of the faucet assembly and showing the handle has been rotated in a clockwise direction about a pivot point as a result of an upward force to allow discharge of liquid from the liquid dispenser.
Figure 8:
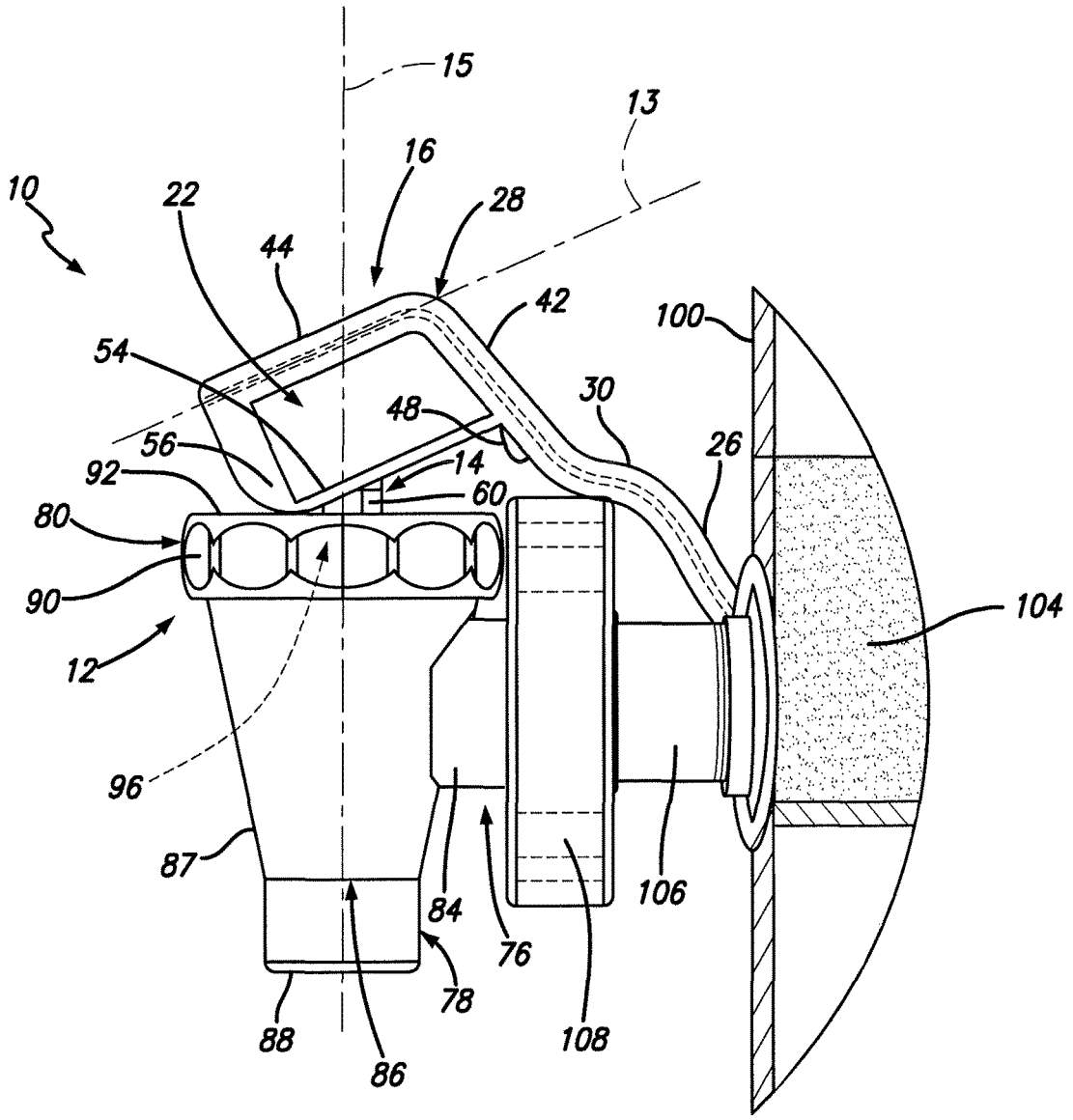
FIG. 8 is a side view of a faucet assembly in accordance with the present disclosure showing a liquid dispenser is connectable to an outlet tube of a container to allow liquid stored in the container to be discharged through the faucet assembly and showing that the handle assembly has been rotated approximately 180 degrees about a pivot point from the handle assembly in FIG. 2 to abut against the outlet tube and be maintained in a third position in which a valve assembly coupled to the handle assembly is positioned in an open position relative to the liquid dispenser for allowing removal of liquid from the container, through the liquid dispenser, and out of the faucet assembly without the continued upward force of FIG. 2.

A faucet assembly 10 in accordance with the present disclosure includes a liquid dispenser 12, a valve assembly 14, and a handle assembly 16 as shown, for example, in FIGS. 1, 2 and 8. Valve assembly 14 is coupled to liquid dispenser 12 and is configured to move relative to liquid dispenser 12 to control the discharge of liquid 104 stored in a container 100 that liquid dispenser 12 is coupled to, as suggested in FIGS. 2 and 8. Handle assembly 16 is coupled to valve assembly 14 to define a valve space 19 therebetween. Handle assembly 16 is configured to move valve assembly 14 from a closed position as shown in FIG. 1 to an open position to allow liquid 104 in container 100 to flow out through liquid dispenser 12. Handle assembly 16 includes a lever 20 that extends downward and outward from where handle assembly 16 is coupled to valve assembly 14 to provide accessible control of valve assembly 14 at a height suitable for compliance with ADA Guidelines.

When handle assembly 16 is in a first position, as shown in FIG. 1, valve assembly 14 is in the closed position and discharge of liquid 104 through a first or, as shown, horizontal flow channel 18 in liquid dispenser 12 is blocked by valve assembly 14. When a user-applied force 11 is applied to handle assembly 16 by lifting up on the downwardly extending lever 20, handle assembly 16 is moved to a second position and valve assembly 14 is moved to the open position that does not block horizontal flow channel 18, as shown in FIG. 2. When valve-assembly 14 is in the open position, liquid 104 stored in container 100 can flow through liquid dispenser 12 and be discharged out of faucet assembly 10.

Handle assembly 16 includes lever 20, a base 22, and one or more pivot pins 24, as seen in FIGS. 3-7. Base 22 is coupled to lever 20 and configured to extend downward toward liquid dispenser 12 to abut against liquid dispenser 12 when handle assembly 16 is in the first position. Pivot pins 24 are appended to base 22 and are configured to be coupled to valve assembly 14 in order to provide movement of valve assembly 14 when handle assembly 16 is moved by user-applied force 11.

As shown, for example, in FIGS. 1, 2, 4 and 7, lever 20 includes a gripping portion 26, a connecting portion 28, and an angled extender 30. Angled extender 30 is appended to the top of gripping portion 26 and is appended to the bottom of connecting portion 28 to bridge gripping portion 26 and connecting portion 28 together, as seen in FIGS. 3-7. Gripping portion 26, connecting portion 28 and angled extender 30 are configured such that, when a user actuates lever 20 of handle assembly 16 with user-applied force 11, gripping portion 26, connecting portion 28 and angled extender 30 move together as a unified piece.

Figure 4:
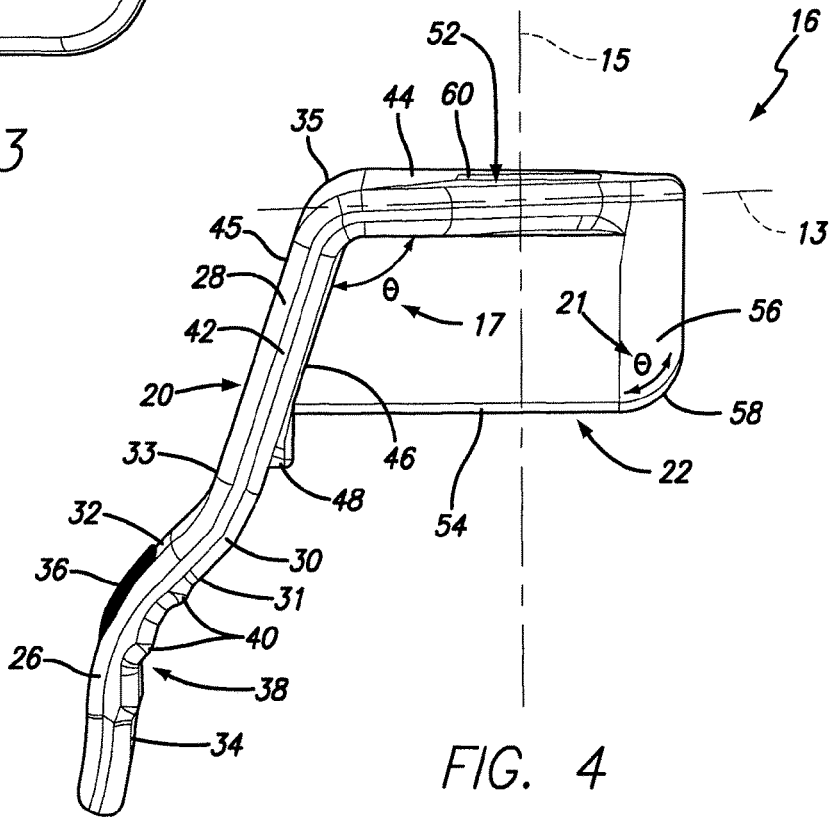
FIG. 4 is a side perspective view of the handle assembly of FIG. 3 showing the handle assembly includes the lever and a base coupled to a backside of the lever, the lever including a contoured grip on a backside of the gripping portion and the gripping portion angling away and downward from the base, the connecting portion of the lever including a side wall and a top wall forming an obtuse angle downward and outward from the top wall, the base including guide rails configured to abut against the liquid dispenser when the handle assembly is in the first position and a cam mechanism configured to pivot the base upward in a direction away from the closure top when the lever of the handle assembly is rotated upward to the second position.

Gripping portion 26 includes a front face 32 and a back face 34. Front face 32 may, in at least one embodiment, include indicia 36 that instruct a user on how to actuate handle assembly 16. Alternatively, the indicia 36 could be left off of the front fact 32. As shown in FIGS. 4-7, back face 34 of gripping portion 26 may, in at least one embodiment, include a contoured grip 38 to provide a place for a user's fingers to grip when actuating handle assembly 16. Contoured grip 38 includes ribs 40 to accommodate a range of user's finger dimensions, positive gripping, and comfort. As shown in FIG. 4, ribs 40 are arranged to extend in an inward direction toward liquid dispenser 12 when handle assembly 16 is coupled to valve assembly 14 and liquid dispenser 12.

Angled extender 30 is slightly angled in an outward direction away from liquid dispenser 12. Gripping portion 26 is coupled to angled extender 30 at a connection plane 31, causing gripping portion 26 to be angled further away from liquid dispenser 12. Gripping portion 26 is angled downward at a point below connection plane 31 to provide an indentation for a user's finger to easily grasp contoured grip 38 between gripping portion 26 and liquid dispenser 12.

Figure 3:
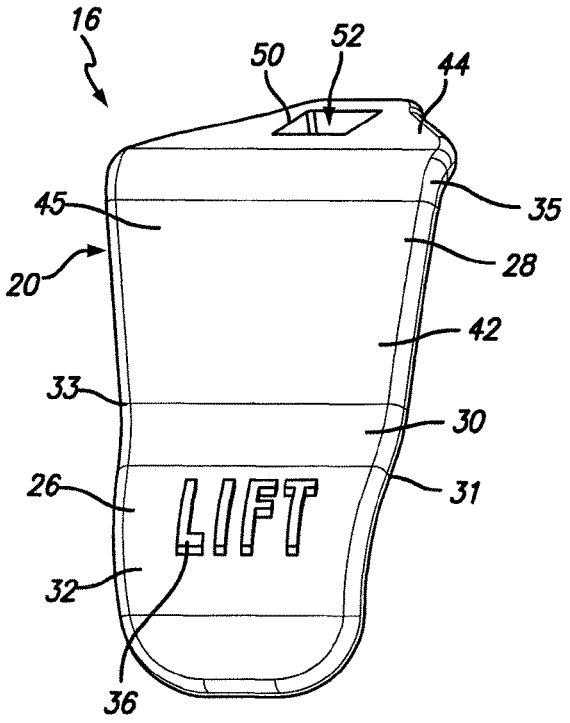
FIG. 3 is an enlarged front perspective view of the handle assembly of FIG. 1 showing a lever of the handle assembly, the lever including a gripping portion, a connecting portion, and an angled extender coupled to the gripping portion and connecting portion, the gripping portion including instructional indicia, and the connecting portion including a shaft window for use in assembling the handle assembly to the valve assembly.

Connecting portion 28 includes a side panel 42 and a top panel 44, as shown in FIGS. 3 and 4. The bottom of side panel 42 is appended to the top of angled extender 30 at a connection plane 33. The top of side panel 42 is appended to top panel 44 at a connection plane 35. Connecting portion 28 is arranged to interconnect gripping portion 26 to base 22 of handle assembly 16 to cause valve assembly 14 coupled to base 22 to move relative to liquid dispenser 12 in response to user-applied force 11 on gripping portion 26.

Side panel 42 and top panel 44 are arranged to cause side panel 42 and gripping portion 26 to extend in a downward and outward direction from top panel 44 such that handle assembly 16 extends below valve assembly 14 when coupled to valve assembly 14 and can be activated at a lower height, compared to other prior art faucet which might have a substantially vertically oriented handle, to comply with ADA Guidelines. In illustrative embodiments, side panel 42 extends downward at a handle angle 17 that is generally greater than 90 degrees from top panel 44 along a top axis 13, preferably at a handle angle 17 between approximately 100 degrees and 110 degrees. Handle angle 17 causes side panel 42 and gripping portion 26 to extend in an outwardly direction away from a valve axis 15 to facilitate a user's finger in actuating lever 20.

Figure 5:
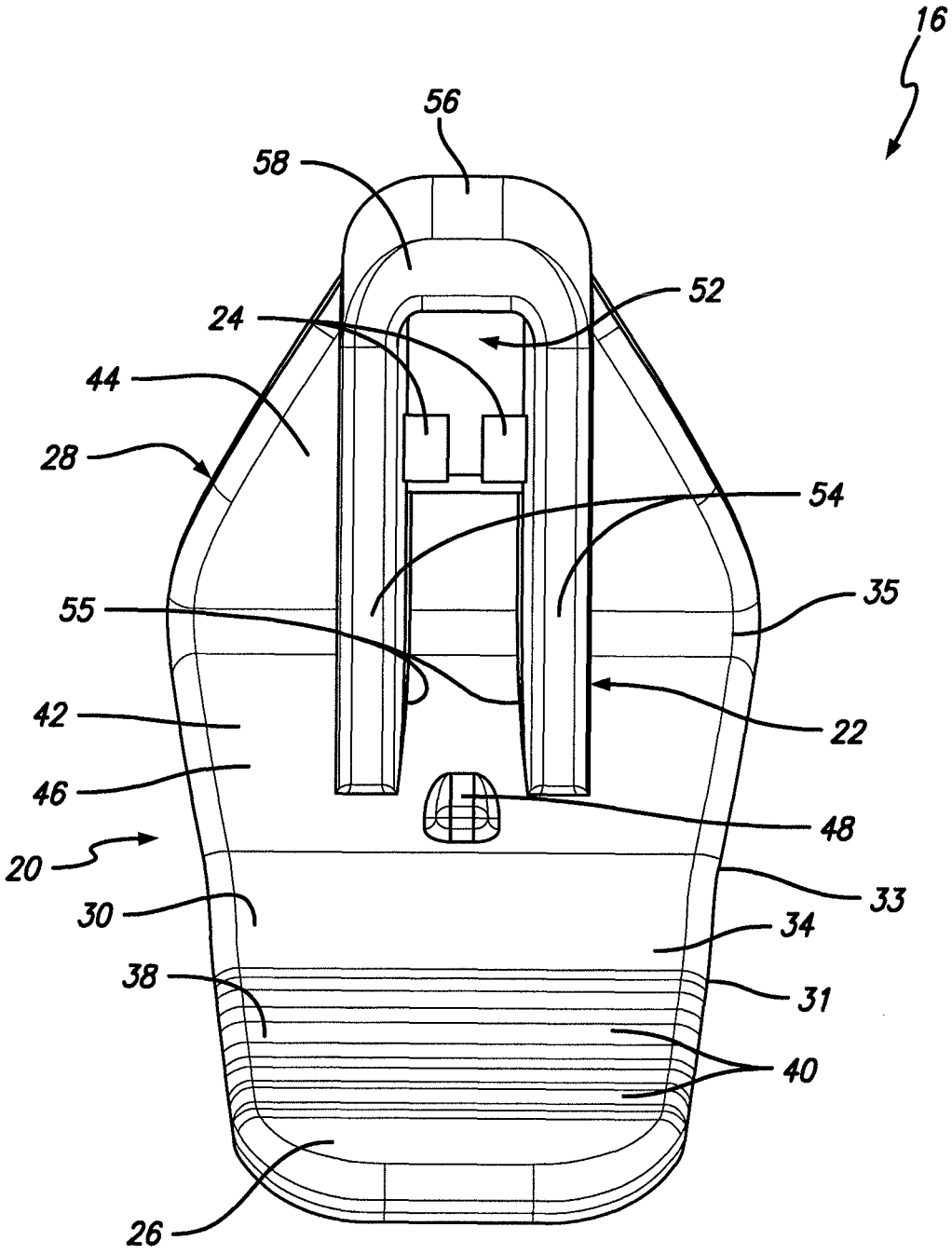
FIG. 5 is a bottom perspective view of the handle assembly of FIG. 3 showing the lever of the handle assembly includes an abutment nub on the backside of the lever that is configured to abut against a side of the liquid dispenser when the handle assembly is in the first position to block rearward movement of the lever to prevent unintended actuation of the lever through inadvertent bumping of the lever, the handle assembly also including a pair of pivot pins coupled to an interior surface of the base and configured to be coupled to an operating shaft of the valve assembly to move the operating shaft up or down through pivotal movement of the handle assembly.
Figure 6:
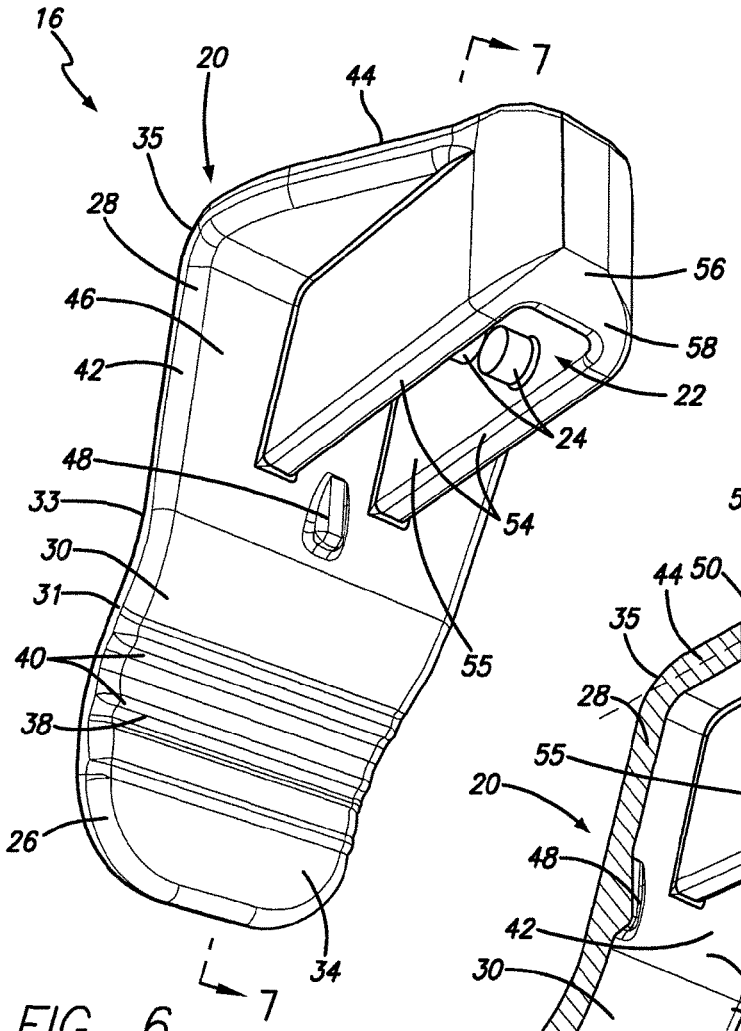
FIG. 6 is an enlarged perspective view of the back and side of the handle assembly of FIG. 3 showing the base of the handle assembly is coupled to both the side wall and top wall of the connecting portion of the lever, the base including the cam mechanism which includes a cam surface adjacent to the guide rails of the base, the cam surface providing an angled edge to the base to facilitate an efficient and smooth movement as the base is moved in an upward direction away from the liquid dispenser when the lever of the handle assembly is rotated upward.

Side panel 42 includes a front face 45 and a back face 46, as shown in FIGS. 4-6. Back face 46 includes an abutment nub 48 arranged to extend in an inward direction toward liquid dispenser 12 when faucet assembly 10 is assembled. In particular, abutment nub 48 is coupled to lever 20 and arranged to abut against liquid dispenser 12 when handle assembly 16 is in the first position, blocking movement of lever 20 in a rearward direction toward liquid dispenser 12, as shown, for example, in FIGS. 1, 4 and 6. In this way, abutment nub 48 may act to block unintended operation or actuation of handle assembly 16 in a rearward direction toward liquid dispenser 12. In illustrative embodiments, abutment nub 48 may abut against any part of liquid dispenser 12 when handle assembly 16 is in the first position.

Top panel 44 of connecting portion 28 includes a shaft window 50 that is formed to include a shaft orifice 52. Shaft orifice 52 is arranged to open into valve space 19, as shown, for example, in FIG. 1. Shaft orifice 52 is configured to be substantially aligned with valve axis 15 and is of substantial width to allow for a portion of valve assembly 14 to travel through shaft orifice 52 during assembly or use.

Base 22 of lever 20 includes guide rails 54 and cam mechanism 56. As shown, for example, in FIGS. 4-7, guide rails 54 are appended to side panel 42 and top panel 44 and arranged to extend in a downward direction toward liquid dispenser 12. Cam mechanism 56 is appended to guide rails 54 and top panel 44. When handle assembly 16 is in the first position, guide rails 54, top panel 44, side panel 42, cam mechanism 56 and liquid dispenser 12 combine to define valve space 19.

As illustrated in FIGS. 1 and 6, guide rails 54 are arranged to abut against the top of liquid dispenser 12 when handle assembly 16 is in the first position, thereby blocking handle assembly 16 from downward gravitational movement. In this way, valve assembly 14 is secured in the closed position to block liquid from flowing through liquid dispenser 12.

Cam mechanism 56 includes curved cam surface 58 configured to facilitate intentional and/or controlled operation of handle assembly 16 when user-applied force 11 is applied to handle assembly 16. As shown in FIG. 2, cam surface 58 is configured to rotatably abut against the top of liquid dispenser 12 when user-applied force 11 is applied to handle assembly 16 to allow for controlled and/or predictable operation of faucet assembly 10. In illustrative embodiments, curved cam surface may include a generally uniform radius of curvature 21, designed to allow the valve to open or "crack" when approximately 5 in/lbs of force is applied to the handle assembly 16.

Figure 7:
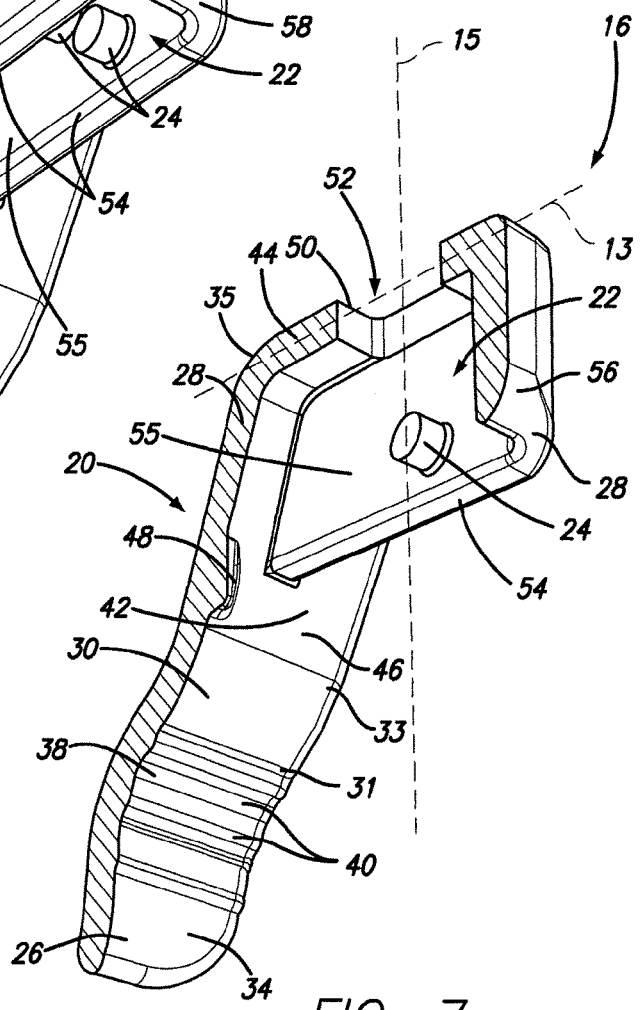
FIG. 7 is a cross-sectional view along the plane 7-7 in FIG. 6 showing the top wall of the handle assembly includes a shaft window formed to include an assembly orifice, the assembly orifice configured to allow a portion of the operating shaft to move through the top wall when coupling the handle assembly to the valve assembly.

As shown, for example, in FIGS. 6 and 7, pivot pins 24 are appended to an interior surface 55 of guide rails 54 and are generally in parallel alignment with shaft orifice 52 along valve axis 15. Pivot pins 24 are configured to be integrally formed and couple the handle assembly 16 to valve assembly 14 in order to facilitate movement of valve assembly 14 through movement of handle assembly 16. The pivot pins could, alternatively, be configured as a separate rod or pair of rods extending through a least one of the side walls 54.

Valve assembly 14 may be configured similar to traditional valve assemblies in traditional faucets. In illustrative embodiments, valve assembly 14 includes an operating shaft 60 and a valve plug 62. As shown in FIGS. 1 and 2, operating shaft 60 is coupled to valve plug 62 at a plug-receiving end 64 of operating shaft 60. Operating shaft 60 also includes a handle-receiving end 66 to couple valve assembly 14 to handle assembly 16. In particular, handle-receiving end 66 includes a pin groove 68 to securably receive pivot pins 24 of handle assembly 16 to lock handle assembly 16 onto valve assembly 14.

Operating shaft 60 is configured to move up and down along valve axis 15 when handle assembly 16 is actuated. When user-applied force 11 is applied to handle assembly 16, lever 20 rotates up about pivot pins 24. Such rotation causes cam mechanism 56 to engage with liquid dispenser 12 to facilitate efficient movement of handle assembly 16. Movement of handle assembly 16 causes pivot pins 24 connected to base 22 to move upward along valve axis 15. As pivot pins 24 are connected to pin groove 68 of operating shaft, operating shaft 60 also moves upward along valve axis. Faucet assembly 10 is arranged to prevent movement of operating stem 60 in a vertically upward direction until the user's hand manually moves handle assembly 16 by applying user-applied force 11 in order to prevent unintended opening of the faucet assembly 10.

Valve plug 62 is coupled with operating shaft 60 such that both valve plug 62 and operating shaft 60 are movable along valve axis 15 when handle assembly 16 is actuated. Valve plug 62 includes an annular side wall 70 that is configured to block the flow of liquid 104 through liquid dispenser 12 when valve assembly 14 is in the closed position, as seen in FIG. 1. When handle assembly 16 is moved to the second position to move valve assembly 14 to the open position, valve plug 62 moves upward with operating shaft 60 to allow flow of liquid through liquid dispenser 12, as shown in FIG. 2. In illustrative embodiments, valve plug 62 is coupled to operating shaft 60 through a shaft-receiving orifice 72 in a top wall 74 of valve plug 62. In particular, plug-receiving end 64 of operating shaft 60 is lockably coupled into shaft-receiving orifice 72 of valve plug 62.

Liquid dispenser 12 includes a dispenser body 76, a nozzle 78, and a closure top 80. Dispenser body 76 and nozzle 78 are coupled together at substantially a right angle, as shown in FIGS. 1, 2 and 8. Closure top 80 can be coupled to nozzle 78 to enclose liquid dispenser 12.

As shown in FIG. 8, dispenser body 76 is coupleable to an outlet tube 106 of container 100. Dispenser body 76 includes an annular body wall 84 and threading 82 appended to one end of annular body wall 84. Annular body wall 84 defines horizontal flow channel 18 to allow liquid 104 to flow through liquid dispenser 12 in order to dispense liquid 104 from container 100. In illustrated embodiments, dispenser body 76 may be coupled to outlet tube 106 via a coupling washer 108 that engages with threading 82 of dispenser body 76.

Nozzle 78 of liquid dispenser 12 is of similar configuration as found in traditional faucet assemblies and includes an opening 88, an open top end 77, and an annular nozzle wall 87 formed to include a vertical flow channel 86. As illustrated, for example, in FIGS. 1 and 2, open top end 77, opening 88 and vertical flow channel 86 are substantially in parallel alignment along valve axis 15. When valve assembly 14 is in the closed position, valve plug 62 blocks all liquid flowing from horizontal flow channel 18 of dispenser body 76 from entering vertical flow channel 86. When valve assembly 14 is in the open position, liquid is allowed to flow from horizontal flow channel 18 into vertical flow channel 86 and out through opening 88.

Closure top 80 includes an annular skirt 90, a top wall 92, and an annular lip 94. As illustrated in FIGS. 1, 2 and 8, annular skirt 90 depends from the outer circumference of top wall 92 and is configured to be secured onto top end 77 of nozzle 78. Annular lip 94 is coupled to top wall 92 inside the circumference of annular skirt 90. Annular lip 94 extends downward from top wall 92 and is substantially parallel to annular skirt 90.

Annular lip 94 defines a valve-assembly orifice 96 in closure top 80. Annular lip 94 and valve-assembly orifice 96 are generally aligned with valve axis 15. As shown in FIGS. 1 and 2, operating shaft 60 is arranged to extend through valve-assembly orifice 96 defined by annular lip 94 and into valve space 19 so that operating shaft may be engagably coupled to handle assembly 16 to move valve assembly 14 from the closed position to the open position. Annular lip 94 creates frictional engagement with operating shaft 60 to ensure operating shaft 60 is properly aligned with valve-assembly orifice 96 and valve axis 15.

FIG. 8 illustrates use of faucet assembly 10 in a servicing or cleaning position. In particular, handle assembly 16 has been rotated approximately 180 degrees around valve axis 15 to a third position. In this third position, lever 20 of handle assembly 16 abuts against washer 108 and outlet tube 106 to maintain handle assembly 16 at the relative height and rotation as it is in the second position but without user-applied force 11. By maintaining handle assembly 16 in this third position, valve assembly 14 is maintained in the open position and allows liquid 104 to flow through liquid dispenser 12 without user-applied force 11. Such third position is advantageous when, for example, cleaning or emptying container 100 for service.

Faucet assembly 10 is assembled in a series of illustrative operations. In a first operation, valve assembly 14 is inserted into top end 77 of nozzle 78 along valve axis 15. Closure top 80 is the coupled to nozzle 78 and operating shaft 60 is positioned through valve-assembly orifice 96 of closure top 80 to extend through and out of liquid dispenser 12. In a second operation, handle assembly 16 is then coupled to valve assembly 14 by extending operating shaft 60 in an upward direction through shaft orifice 52 of lever 20 until pin groove 68 of operating shaft 60 lines up with pivot pins 24 of handle assembly 16. During assembly, operating shaft 60 is arranged to extend out of valve space 19 through shaft orifice 52 so that pivot pins 24 can be properly aligned with pin groove 68 of operating shaft 60. Pivot pins 24 then can be positioned into pin groove 68 to retainably couple valve assembly 14 to handle assembly 16. In a third operation, dispenser body 76 of liquid dispenser 12 is coupled to outlet tube 106 of container 100 to allow selective dispensing of liquid 104 from container 100.

As an example of use of faucet assembly 10, handle assembly 16 begins in the first position with the valve assembly 14 in a closed position blocking discharge of liquid

104 through liquid dispenser 12. In a first stage of use, the user lifts handle assembly 16 in an upward direction relative to liquid dispenser 12 to the second position by user-applied force 11, as shown in FIG. 2. Such movement causes valve assembly 14 to move upward to an open position and valve plug 62 ceases to block liquid from moving through liquid dispenser 12. After use is complete, the user stops applying user-applied force 11 and allows handle assembly 16 to return to the first position, causing valve assembly 14 to return to the closed position. When a user wishes to service or empty container 100, the user rotates handle assembly 16 approximately 180 degrees until handle assembly 16 can be maintained in the third position without user-applied force 11 by securing handle assembly 16 in an open position to be abutting against outlet tube 106. This enables valve assembly 14 to be maintained in the open position to allow liquid 104 to freely flow through liquid dispenser 12.

The invention claimed is:

1. A faucet assembly for controlling the dispensing of liquids from a liquid container, the faucet assembly comprising:

a liquid dispenser having a flow channel for attachment to and communication with the liquid container and a nozzle communicating with the flow channel for permitting the flow of liquids, the liquid dispenser including a closure top on a top end of the nozzle;

a valve assembly coupled to the liquid dispenser and configured to be moveable to control flow of liquid from the container through the liquid dispenser and through the nozzle, the valve assembly including a valve plug and an operating shaft coupled to the valve plug, the operating shaft extending through the closure top to be outside of the liquid dispenser, the valve plug being movable from a closed position blocking flow of liquids from flow the channel to the nozzle to an open position allowing flow of liquids from the flow channel to the nozzle; and a handle assembly including a lever, a base, and at least one pivot pin, the base being positioned proximate the operating shaft and closure top of the liquid dispenser, the at least one pivot pin being appended to the base and coupled with the operating shaft, the lever extending from the base for controllably moving the base, a cam mechanism on the base spaced from the lever on the opposite side of the operating shaft and downwardly spaced from the at least one pivot pin, the cam mechanism abutting the closure top to facilitate cammed movement of the operating shaft and the valve plug carried thereon when the lever is displaced relative to the liquid dispenser.

2. The faucet assembly of claim 1 wherein the lever includes a side panel and a top panel, the top panel and side panel forming an obtuse angle such that the side panel extends downward and outward from the top panel.

3. The faucet assembly of claim 1 wherein the lever extends downward and outward from the base and includes a gripping portion that extends below the closure top of the liquid dispenser when the handle assembly is in a first position such that the valve plug is in the closed position.

4. The faucet assembly of claim 1 wherein the cam mechanism includes a curved cam surface configured to facilitate controlled linear movement of the operating shaft relative to the closure top.

5. The faucet assembly of claim 1 wherein the base includes side panels defining corresponding guide rails along a lower edge thereof abutting the closure top, the guide rails preventing movement opposite the operation of the cam mechanism and block unintended movement of the operating shaft.

6. A beverage server with a faucet assembly for controlling the dispensing of liquids from the beverage server, the faucet assembly comprising:

a liquid dispenser having a flow channel for attachment to and communication with the beverage server and a nozzle communicating with the flow channel for permitting the flow of liquids, the liquid dispenser including a closure top on a top end of the nozzle;

a valve assembly coupled to the liquid dispenser and configured to be moveable to control flow of liquid from the container through the liquid dispenser and through the nozzle, the valve assembly including a valve plug and an operating shaft coupled to the valve plug, the operating shaft extending through the closure top to be outside of the liquid dispenser, the valve plug being movable from a closed position blocking flow of liquids from flow the channel to the nozzle to an open position allowing flow of liquids from the flow channel to the nozzle; and a handle assembly including a lever, a base, and at least one pivot pin, the base being positioned proximate the operating shaft and closure top of the liquid dispenser, the at least one pivot pin being appended to the base and coupled with the operating shaft, the lever extending from the base for controllably moving the base, a cam mechanism on the base spaced from the lever on the opposite side of the operating shaft and downwardly spaced from the at least one pivot pin, the cam mechanism abutting the closure top to facilitate cammed movement of the operating shaft and the valve plug carried thereon when the lever is displaced relative to the liquid dispenser.

7. The beverage server of claim 6 wherein the base includes a side panel and a top panel, the top panel and side panel forming an obtuse angle such that the side panel extends downward and outward from the top panel.

8. The beverage server of claim 6 wherein the lever extends downward and outward from the base and includes a gripping portion that extends below the closure top of the liquid dispenser when the handle assembly is in a first position such that the valve plug is in the closed position.

9. The beverage server of claim 6 wherein the cam mechanism includes a curved cam surface configured to facilitate controlled linear movement of the operating shaft relative to the closure top.

10. The beverage server of claim 6 wherein the base includes side panels defining corresponding guide rails along a lower edge thereof abutting the closure top, the guide rails preventing movement in opposite the operation of the cam mechanism and block unintended movement of the operating shaft.

* * * * *